United States Patent [19]

Smith

[11] 4,082,258

[45] Apr. 4, 1978

[54] DRIVE SPEED CONTROL APPARATUS FOR CLOTH SPREADING MACHINE

[75] Inventor: Hoyt L. Smith, Nashville, Tenn.

[73] Assignee: Cutters Machine Company, Inc., Nashville, Tenn.

[21] Appl. No.: 754,172

[22] Filed: Dec. 27, 1976

[51] Int. Cl.[2] ..... B65H 29/46

[52] U.S. Cl. ..... 270/31

[58] Field of Search ..... 270/30–31

[56] References Cited

U.S. PATENT DOCUMENTS

| | | | |
|---|---|---|---|
| 2,148,375 | 2/1939 | Krassner | 270/31 |
| 3,526,398 | 9/1970 | Merrill | 270/31 |
| 3,713,642 | 1/1973 | Paterson | 270/31 |

*Primary Examiner*—Ernest T. Wright, Jr.
*Assistant Examiner*—A. Heinz
*Attorney, Agent, or Firm*—Harrington A. Lackey

[57] ABSTRACT

A motor-driven cloth spreading machine having a speed control apparatus manually operated by a rotary elongated control shaft having radial handle means for rotating the control shaft.

The speed control apparatus may also include a trip lever operatively connected to the control shaft and adapted to counter-rotate the control shaft to reduce the speed of the machine when the trip lever engages a tripping device at a predetermined station in the path of the spreading machine.

6 Claims, 4 Drawing Figures

DRIVE SPEED CONTROL APPARATUS FOR CLOTH SPREADING MACHINE

BACKGROUND OF THE INVENTION

This invention relates to a cloth spreading machine, and more particularly to a drive speed control apparatus for a cloth spreading machine.

Drive speed control apparatus for cloth spreading machines are known in the art, such as those described in U.S. Pat. No. 3,540,720, issued to Edward M. Merrill on Nov. 17, 1970, and U.S. Pat. No. 3,713,642, issued to Stephen Paterson on Jan. 30, 1973.

Both the Merrill and the Paterson patents disclose cloth spreading machines driven by electrical motors controlled by rheostats which are actuated by manual control mechanisms of different types. These manual control mechanisms are designed to permit an operator walking alongside the moving cloth spreading machine to control the speed of the machine by manipulating a handle, which is linked to means for varying the resistance in a rheostat or potentiometer.

Both the Merrill and Paterson patents include an elongated rigid link bar as a means for connecting the handle member to the wiper of the electrical rheostat.

Both the handle members disclosed in the Merrill and Paterson patents are difficult to manipulate because they require an exceptional amount of strength in the hand or wrist of the operator, and incorporate a minimal mechanical advantage between the handle member and the wiper of the rheostat.

SUMMARY OF THE INVENTION

It is therefore an object of this invention to provide a cloth spreading machine incorporating a manually operated drive speed control, which is more responsive to hand manipulation by the operator, and requiring a minimum of exertion and strength by the operator. Moreover, this drive speed control incorporates an improved mechanical advantage in the handle means and the linkage operatively connected to the speed control device.

Specifically, the drive speed control apparatus comprises a rotary elongated shaft having at its end portion an elongated handle member extending radially from the shaft. A chain-sprocket linkage couples the rotary shaft to a powerstat for varying the A.C. voltage to the electrical drive motor for the cloth spreading machine, in response to the rotary position of the handle member and control shaft.

In the preferred form of the invention, the speed control apparatus also includes an automatic tripping device for actuating the speed control into low speed as the spreading machine moves past a predetermined station, and particularly a station proximate to the catcher mechanism, in order to prevent damage to the machine as it moves into the catcher mechanism at high speed. This tripping mechanism includes a pivotal trip lever having one end connected by a link element to a rotary wheel member fixed to the elongated control shaft. The opposite end of the trip lever is adapted to engage a cam shaped ramp at the predetermined location in order to counter-rotate the control shaft to a low speed position.

DESCRIPTION OF THE PREFERRED EMBODIMENTS

Figure 1:
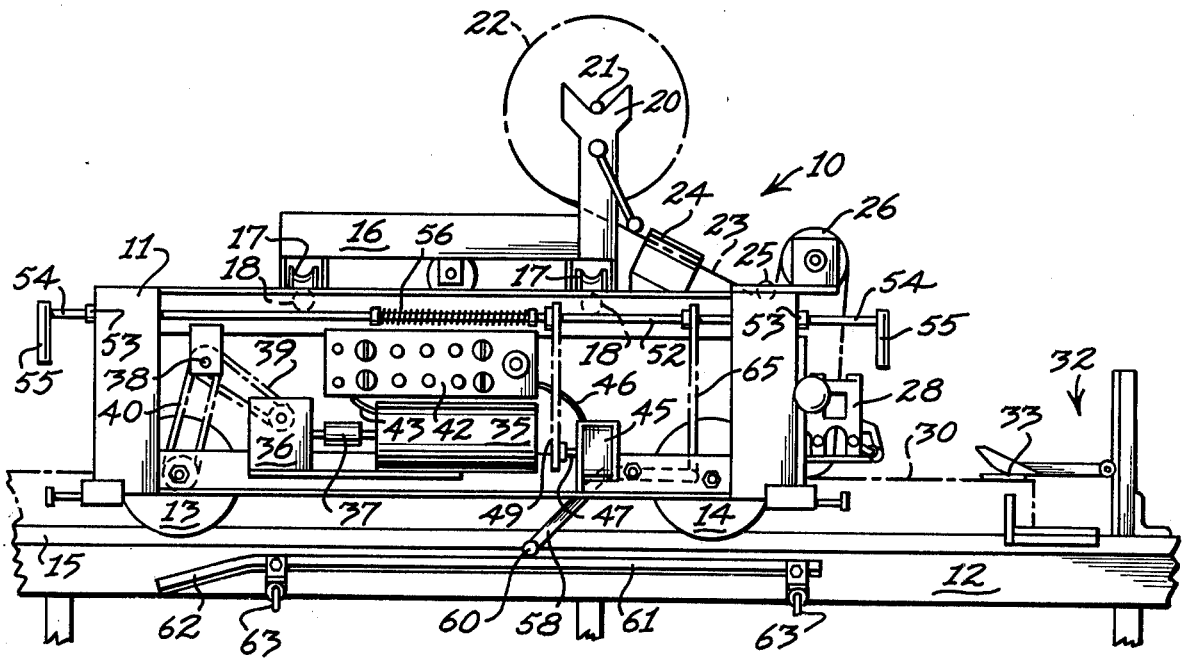
FIG. 1 is a side elevation of the cloth spreading machine incorporating a drive speed control apparatus made in accordance with this invention, taken from the operator side.

Referring now to the drawings in more detail, the cloth spreading machine 10 made in accordance with this invention includes a frame, or machine frame, 11 supported by smooth-surfaced wheels, not shown, on the remote side of the frame 11 for rolling movement over the top surface of a spreading or cutting table 12. The proximal side of the machine is supported by the grooved wheels 13 and 14 for movement along a track or rail 15, in a conventional manner.

Mounted on top of the machine frame 11 is a cloth supply carriage 16 having grooved rollers 17 rollably supported on transverse rails 18 for reciprocable lateral movement of the supply carriage 16 relative to the machine frame 11.

Mounted at either end, or both ends, of the cloth supply carriage 16 are a pair of cloth roll support standards 20, only one of the pair at one end of the carriage 16 being visible in FIG. 1. The pair of standards 20 support a spindle 21 upon which is wound a cloth supply roll 22.

From the cloth supply roll 22, a web of cloth 23 passes through an edge sensor 24 of conventional design, beneath a guide bar 25, over a cloth feed roll 26 mounted on one end of the machine frame 11, and thence down through and beneath a conventional spreader unit 28. The spreader unit 28 spreads or lays the web 23 upon the surface of the table 12 in layers 30, as the machine frame reciprocates longitudinally over the spreader or cutting table 12, and between catcher mechanisms, such as the catcher mechanism 32 at the right end of FIG. 1, of conventional design, and having a hold-down or catcher bar 33.

As best disclosed in FIG. 1, a motor 35 mounted on the machine frame 11 drives a gear reducer 36, through shaft coupling 37. The gear reducer 36 drives the wheel drive shaft 38 through sprocket and chain transmission 39. Power from the wheel drive shaft 38 is transmitted to the wheel 13 through sprocket and chain transmission 40.

The control and instrument panel 42 on the machine frame 11 contains the circuitry for energizing and controlling the electrical motor 35, as well as the motor, not shown, for driving the cloth supply carriage 16 laterally and reciprocably in response to the edge sensor 24. The circuitry in the control panel 40 is connected to the electrical motor 35 through the cable 43.

A rotary powerstat 45 is mounted upon the frame 11 and is connected through electrical leads in the cable 46 to the circuitry within the control panel 42, for controlling the speed of the electrical motor 35 and thereby the longitudinal speed of the machine frame 11. The element, not shown, within the powerstat 45 for varying the effective number of turns in the secondary coil of a transformer, is mounted upon the rotary shaft 47, to vary the A.C. voltage to the electrical motor 35. A driven sprocket 48 is fixed at the end of the rotary shaft 47, and is coupled through a chain 49 to a drive sprocket 50 concentrically fixed upon a control shaft 52. The control shaft 52 is rotatably mounted within bearings, such as bearings 53, upon the machine frame 11. In a preferred form of the invention, the rotary control shaft 52 extends the entire length of the frame 11, adjacent the operator's side, and has free end portions 54 projecting from the opposite ends of the frame 11.

Each end portion 54 of the control shaft 52 terminates in a handle member, such as the elongated handle bar 55, projecting radially from the control shaft 52. The radial extent, or length, of the handle bar 55 is substantially greater than the radius of either of the sprockets 48 or 50. Thus, the handle bar 55 provides greater leverage, and therefore greater mechanical advantage, for manipulation of the powerstat shaft 47, with less exertion and effort by the hand of the operator.

By merely grasping the handle bar 55, and preferably near either free end, the operator, walking alongside the moving machine frame 11, may easily control the drive speed of the frame by rotating the handle bar 55 about the longitudinal axis of the control shaft 52. The rotary movement of the handle bar 55 and the rotary shaft 52 is transmitted to the rotary shaft 47, which varies the effective number of turns in the secondary coil of a transformer, forming parts of the powerstat 45, which in turn varies the A.C. voltage transmitted to the bridge circuit, not shown, within the panel 42, which in turn varies the speed of the electrical motor 35, and therefore the longitudinal speed of the machine frame 11 over the table 12.

A return coil spring 56 may be mounted about the control shaft 52 to automatically restore the control shaft to its low speed position when the operator releases his grip upon both handles 55.

In a preferred form of the invention, a trip mechanism 57 is coupled with the control shaft 52 in order to automatically reduce the drive speed of the frame 11 at a predetermined location, even if the operator is still gripping either handle 55, and even if the operator is holding the handle 55 in its high-speed position. This trip mechanism 57 is a safety feature to prevent damage to the machine in the event that the operator inadvertently holds the handle 55 in its high-speed position, particularly as the frame 11 approaches the catcher mechanism 32.

This trip mechanism 57 includes an elongated trip lever 58 pivotally mounted about its middle portion by a pivot pin 59 fixed upon the frame 11. The lower end of the lever 58 is provided with a cam or cam roller 60 adapted to engage a longitudinally aligned ramp 61, having a sloping or camming portion 62, as the machine frame 11 approaches the ramp 61. The ramp 61 is fixed upon the table 12 along the operator's side at a predetermined location or station, preferably adjacent the catcher mechanism 32, by appropriate supports, such as the C-clamps 63. The upper end of the trip lever 58 is connected by a fixed connector 64 to a flexible member or chain 65, the upper end portion of which is cooperatively fixed to and wrapped about a wheel member or sprocket 66 concentrically fixed to the control shaft 52.

Figure 2:
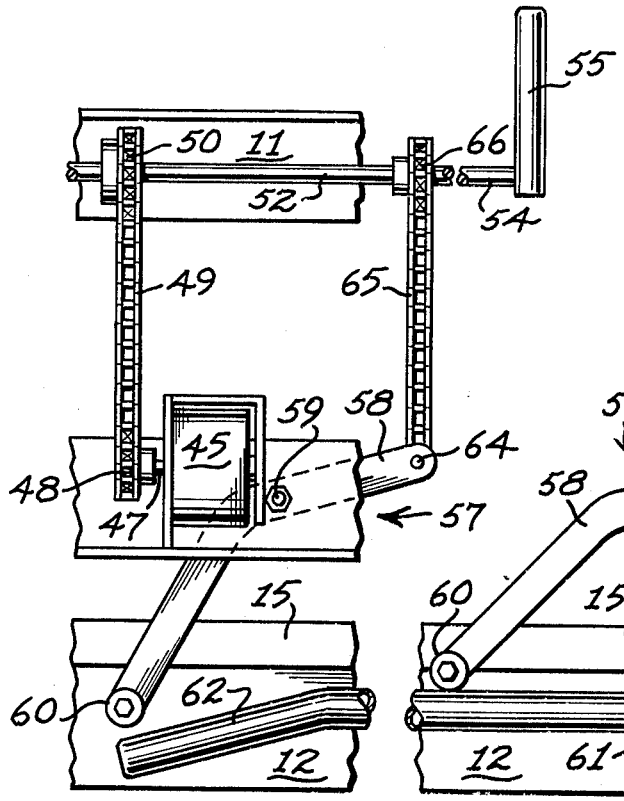
FIG. 2 is an enlarged, fragmentary, side elevational view of the drive speed control mechanism and tripping mechanism, disclosed in high speed position.
Figure 3:
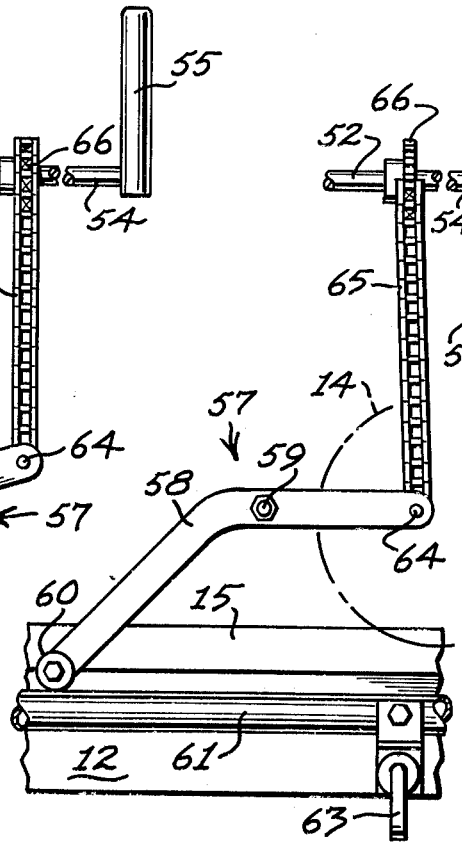
FIG. 3 is a view similar to FIG. 2, but disclosing only the tripping mechanism in low speed position.
Figure 4:
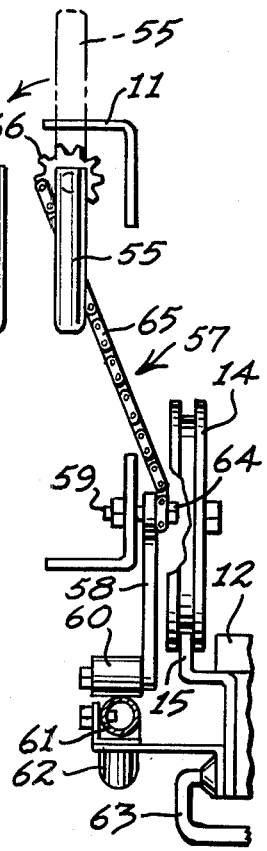
FIG. 4 is a right end elevation of the mechanism disclosed in FIG. 3.

Thus, if the handle bar 55 is in its upper, high-speed position, as disclosed in FIG. 2, with the upper portion of the chain 65, wrapped about the sprocket 66, pulling upward the upper end of the lever 58, and depressing the lower end of the lever 58, the cam roller 60 will be in a position lower than the upper surface of the ramp 61, as disclosed in FIG. 2. If the operator neglects to turn the handle bar 55 to a lower or downward position, as disclosed in FIGS. 1, 3 and 4, the cam roller 60 will engage the inclined portion 62 of the ramp 61 as the frame 11 moves in high speed toward the catcher mechanism 32. As the cam roller 60 rides over the ramp portions 62 and 61, the lever 58 will automatically be pivoted clockwise about the pivot pin 59 to pull down the chain 65 and counter-rotate the wheel member or sprocket 66, causing the handle bar 55 to rotate from its upper high-speed position, disclosed in phantom in FIG. 4, to its lowermost low-speed position, disclosed in solid lines in FIGS. 3 and 4. This forced mechanical movement will override the manually held position of the handle bar 55, to force the machine into low speed, thus preventing disastrous damage to the machine 10, as well as to the catcher mechanism 32, as the spreader unit 28 approaches and cooperates with the catcher bar 33 to fold the upper layer of cloth upon the stack 30.

What is claimed is:

1. In a cloth spreading machine having a frame supporting a spreading mechanism adapted to spread cloth upon a spreading surface as the frame moves longitudinally reciprocably over the spreading surface, drive speed control means comprising:

a. a motor operatively connected to said frame for driving said frame over said spreading surface,
b. a speed control device operatively connected to said motor to vary the speed of said frame,
c. said speed control device having an operator element adapted to actuate said speed control device to vary the speed of said frame in response to the position of said operator element,
d. an elongated control shaft having an operator portion and an end portion,
e. means rotatably mounting said control shaft on said frame for rotation about the longitudinal axis of said control shaft,
f. a handle member fixed to said end portion of said control shaft whereby said control shaft is manually rotated,
g. first link means operatively connecting the operator portion of said control shaft to said operator element, whereby rotation of said control shaft commensurately varies the speed of said frame,
h. a driven rotary element fixed concentrically to said control shaft,
i. a trip lever pivotally mounted upon said frame,
j. a trip device fixed relative to said spreading surface at a station in the path of said trip lever for engaging and pivotally moving said trip lever as said frame moves over said station,
k. second link means connecting said trip lever to said driven rotary element for simultaneously rotating said control shaft to decrease the speed of said frame as said trip lever is moved by said trip device.

2. The invention according to claim 1 in which said trip device comprises an elongated ramp and said trip lever and said ramp are disposed in the same vertical longitudinal plane, said trip lever being pivoted about a transverse horizontal axis.

3. The invention according to claim 2 in which said trip lever comprises end portions on opposite sides of said pivotal axis, one of said end portions comprising a cam member for engaging said ramp, said second link means comprising a link element connecting the opposite end of said trip lever eccentrically to said driven rotary element.

4. The invention according to claim 3 in which said driven rotary element is a wheel member fixed concentrically upon said control shaft, and said link element is a flexible linear member having one end fixed to the periphery of said wheel member and the other end to the opposite end portion of said trip lever.

5. The invention according to claim 4 in which said operator element comprises a driven rotary operator element, and said first link means comprises a drive rotary element concentrically fixed to said control shaft and a link member connecting said drive rotary element to said driven rotary operator element.

6. The invention according to claim 1 in which said handle member is an elongated handle bar fixed to said end portion of said control shaft to project radially from the longitudinal axis of said control shaft.

* * * * *